US010790106B2

(12) United States Patent
Lee

(10) Patent No.: US 10,790,106 B2
(45) Date of Patent: Sep. 29, 2020

(54) RELAY DEVICE

(71) Applicant: LSIS CO., LTD., Anyang-si, Gyeonggi-do (KR)

(72) Inventor: Si-Hyung Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 210 days.

(21) Appl. No.: 16/070,711

(22) PCT Filed: Sep. 8, 2016

(86) PCT No.: PCT/KR2016/010125
§ 371 (c)(1),
(2) Date: Jul. 17, 2018

(87) PCT Pub. No.: WO2017/126765
PCT Pub. Date: Jul. 27, 2017

(65) Prior Publication Data

US 2019/0019645 A1 Jan. 17, 2019

(30) Foreign Application Priority Data

Jan. 20, 2016 (KR) ..... 10-2016-0007236

(51) Int. Cl.
*H01H 50/54* (2006.01)
*H01H 50/60* (2006.01)
(Continued)

(52) U.S. Cl.
CPC ..... *H01H 50/60* (2013.01); *H01H 1/06* (2013.01); *H01H 1/2083* (2013.01);
(Continued)

(58) Field of Classification Search
CPC ..... H01H 50/60; H01H 50/36; H01H 50/18; H01H 50/64
(Continued)

(56) References Cited

U.S. PATENT DOCUMENTS

2015/0303016 A1 10/2015 Sprague et al.
2015/0380194 A1* 12/2015 Lee ..... H01H 51/065 335/192
(Continued)

FOREIGN PATENT DOCUMENTS

CN 203966842 U 11/2014
EP 0595698 A1 10/1993
(Continued)

OTHER PUBLICATIONS

Chinese Office Action for related Chinese Application No. 201680079339.2; action dated Jan. 25, 2019; (9 pages).
(Continued)

*Primary Examiner* — Shawki S Ismail
*Assistant Examiner* — Lisa N Homza
(74) *Attorney, Agent, or Firm* — K&L Gates LLP

(57) ABSTRACT

Disclosed is a relay device including a stator having first and second stationary contact points spaced apart from each other; a movable element provided so as to be movable in a first direction toward the stator and in a second direction away from the stator, the movable element being electrically connected with the stator by making contact with the first and second stationary contact points; and an actuator for moving the movable element in the first or second direction, wherein the movable element includes: a first movable part having a first contact surface formed thereon, which can make contact with the first stationary contact point; and a second movable part having second and third contact surfaces formed thereon, which can make contact with the second stationary contact point, wherein the second and third contact surfaces make contact with the second stationary contact point at different positions.

6 Claims, 6 Drawing Sheets

(51) Int. Cl.

| | |
|---|---|
| ***H01H 1/20*** | (2006.01) |
| ***H01H 1/06*** | (2006.01) |
| ***H01H 50/18*** | (2006.01) |
| ***H01H 50/36*** | (2006.01) |
| ***H01H 50/64*** | (2006.01) |
| *H01H 51/06* | (2006.01) |

(52) U.S. Cl.
CPC ..... *H01H 50/18* (2013.01); *H01H 50/36* (2013.01); *H01H 50/64* (2013.01); *H01H 50/546* (2013.01); *H01H 51/065* (2013.01)

(58) Field of Classification Search
USPC ..... 335/2
See application file for complete search history.

(56) References Cited

U.S. PATENT DOCUMENTS

2016/0079022 A1* 3/2016 An ..... H01H 9/30 335/187
2016/0093458 A1* 3/2016 An ..... H01H 50/18 335/136
2016/0314924 A1* 10/2016 Gaudefroy ..... H01H 1/54
2016/0365210 A1* 12/2016 Blackmon ..... H01H 9/043
2017/0194121 A1* 7/2017 Yang ..... H01H 50/36

FOREIGN PATENT DOCUMENTS

| | | | |
|---|---|---|---|
| EP | 0291895 | A2 | 11/1998 |
| JP | 2005209484 | A | 8/2005 |
| JP | 2012199117 | A | 10/2012 |
| JP | 2013175437 | A | 9/2013 |
| JP | 2013196923 | A | 9/2013 |
| JP | 2014017086 | A | 1/2014 |
| JP | 2015537356 | A | 12/2015 |
| KR | 20140006151 | A | 1/2014 |
| KR | 20150089737 | A | 8/2015 |

OTHER PUBLICATIONS

European Search Report for related European Application No. 16886608.5; report dated Jan. 4, 2019; (8 pages).
Japanese Office Action for related Japanese Application No. 2018-536730; action dated Sep. 3, 2019; (4 pages).

* cited by examiner

RELAY DEVICE

CROSS-REFERENCE TO RELATED APPLICATIONS

The present application is a National Stage of International Application No. PCT/KR2016/010125, filed Sep. 8, 2016, which claims priority to Korean Application No. 10-2016-0007236, filed Jan. 20, 2016, the disclosures of which are incorporated herein by reference.

TECHNICAL FIELD

The present invention relates to a relay apparatus, and more particularly, to a relay apparatus used for opening or closing an electrical circuit.

BACKGROUND ART

Generally, a relay apparatus is an apparatus with an electrical contact point configured to connect or disconnect a current, and is installed in various machines or vehicles to allow any device to be automatically controlled without requiring a person to operate the device as needed.

Examples of such relay apparatuses include polar type relays and sliding type relays.

Among them, the polar type relay is a relay apparatus which operates by switching vertically with respect to an electromagnet to provide switchable contact points.

Polar type relay apparatuses include a unipolar type relay having only ON and OFF functions, and a bipolar type relay which allows a switching operation to be selectively performed.

Among them, a relay apparatus which is mainly used in mechanical and electrical devices such as automobiles is a unipolar type relay.

Such a relay apparatus basically includes an electromagnet, an electric armature, a mover operated in conjunction with the electric armature, a stator provided to be in contact with the mover, or the like, and is operated in such a way that when a current is supplied to a coil of the electromagnet, the electric armature is pulled to mechanically move the mover so that the mover comes into contact with the stator, which becomes an ON or OFF position of the relay apparatus.

The background art of the present invention is disclosed in Korean Patent Application Publication No. 10-2014-0006151 (titled "Relay Module of Vehicle Battery System", published on Jan. 16, 2014).

DISCLOSURE

Technical Problem

The present invention is directed to providing a relay apparatus with an improved structure to improve contact stability between a stator and a mover.

Technical Solution

One aspect of the present invention provides a relay apparatus including: a stator having a first fixed contact point and a second fixed contact point provided to be spaced apart from each other; a mover movably provided in a first direction which is a direction close to the stator or in a second direction which is a direction far from the stator, and electrically connected to the stator by being brought into contact with the first fixed contact point and the second fixed contact point; and an actuator configured to move the mover in the first direction or the second direction, wherein the mover includes: a first mover portion on which a first contact surface provided to be in contact with the first fixed contact point is formed; and a second mover portion on which a second contact surface and a third contact surface provided to be in contact with the second fixed contact point are formed, and the second contact surface and the third contact surface are brought into contact with the second fixed contact point at different positions.

The first contact surface may be formed on the first mover portion to form a plane surface parallel to the first fixed contact point, and the second contact surface and the third contact surface may be formed on the second mover portion to form an inclined oblique surface with respect to the second fixed contact point.

Each of the second contact surface and the third contact surface may be linearly symmetrical about an imaginary line separating the second contact surface and the third contact surface, and may be formed to be inclined upwardly toward an end of the mover in a width direction.

The stator and the mover may be electrically connected to each other in a form of three-point contact in which the first contact surface is brought into contact with the first fixed contact point and each of the second contact surface and the third contact surface is brought into contact with the second fixed contact point

Advantageous Effects

According to a relay apparatus of the present invention, contact stability between a stator and a mover can be effectively improved to reduce contact heat generation, and a shape of the mover can be processed through a press process for easy manufacturing of the apparatus by increasing the number of contact points between the stator and the mover by merely changing the shape of the mover without changing the shape of the stator.

Further, the present invention can effectively improve the contact stability between the stator and the mover by merely changing the shape of the mover without increasing sizes of the stator and the mover, so that a relay apparatus with high contact stability can be provided while a size of the apparatus can be reduced.

Further, not only can the present invention easily manufacture the apparatus by processing the shape of the mover through the press process, but can also provide improved productivity by reducing a risk in which processing defects are generated in the press process.

MODES OF THE INVENTION

Figure 1:
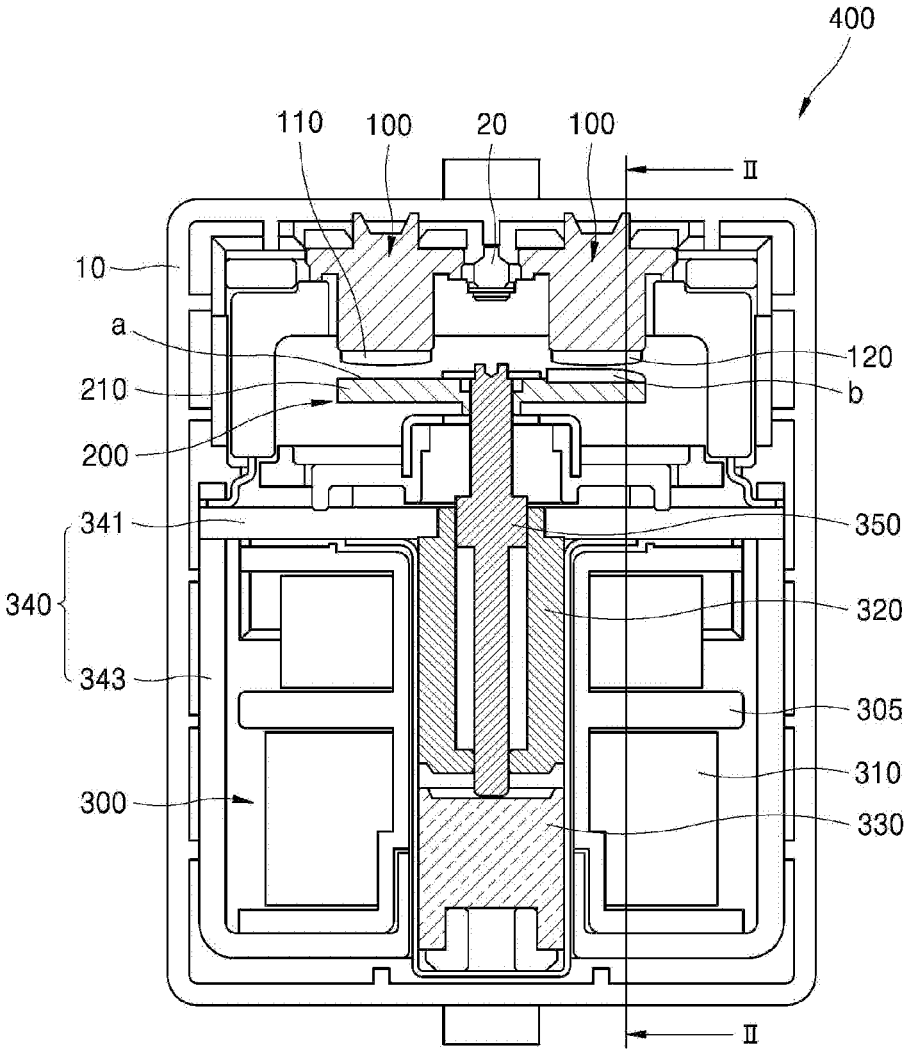
FIG. 1 is a cross-sectional view illustrating an internal structure of a relay apparatus according to one embodiment of the present invention.

Hereinafter, an exemplary embodiment of a relay apparatus according to the present invention will be described with reference to the accompanying drawings. For convenience of descriptions, thicknesses of lines and sizes of components shown in the drawings may be exaggerated. In addition, the terms described below are defined in consideration of functions of the present invention, which may vary depending on the intention of a user or operator, or custom. Therefore, the definitions of the terms should be based on contents throughout this specification.

Figure 2:
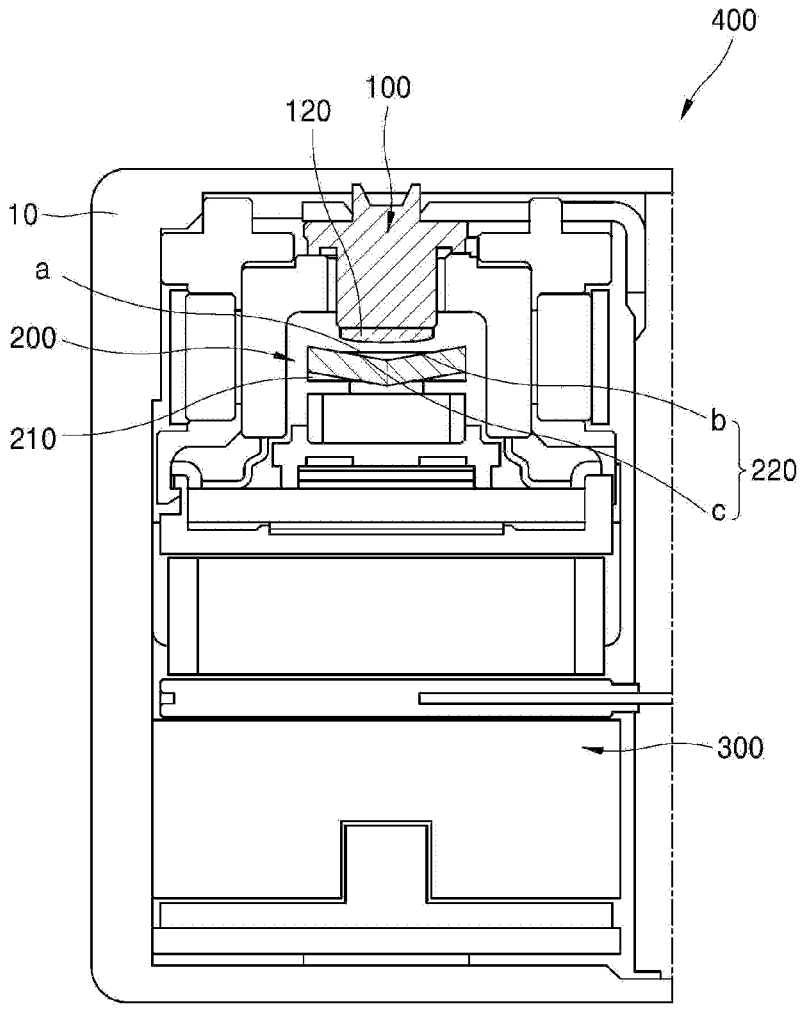
FIG. 2 is a cross-sectional view taken along line "II-II" of FIG. 1.
Figure 3:
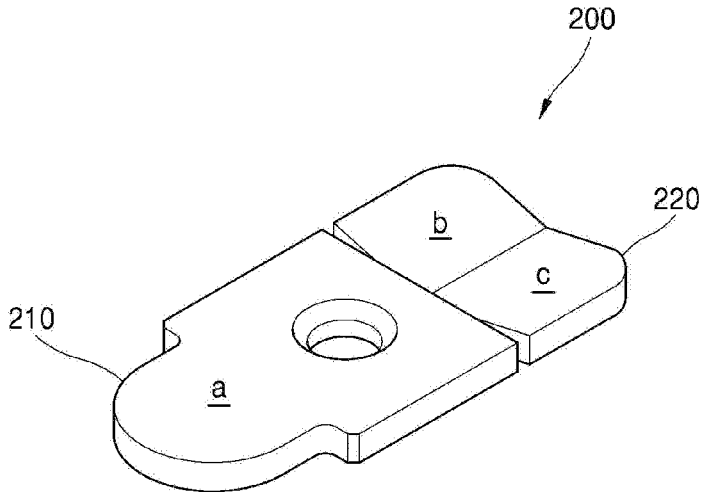
FIG. 3 is a perspective view illustrating a mover shown in FIG. 2.
Figure 4:
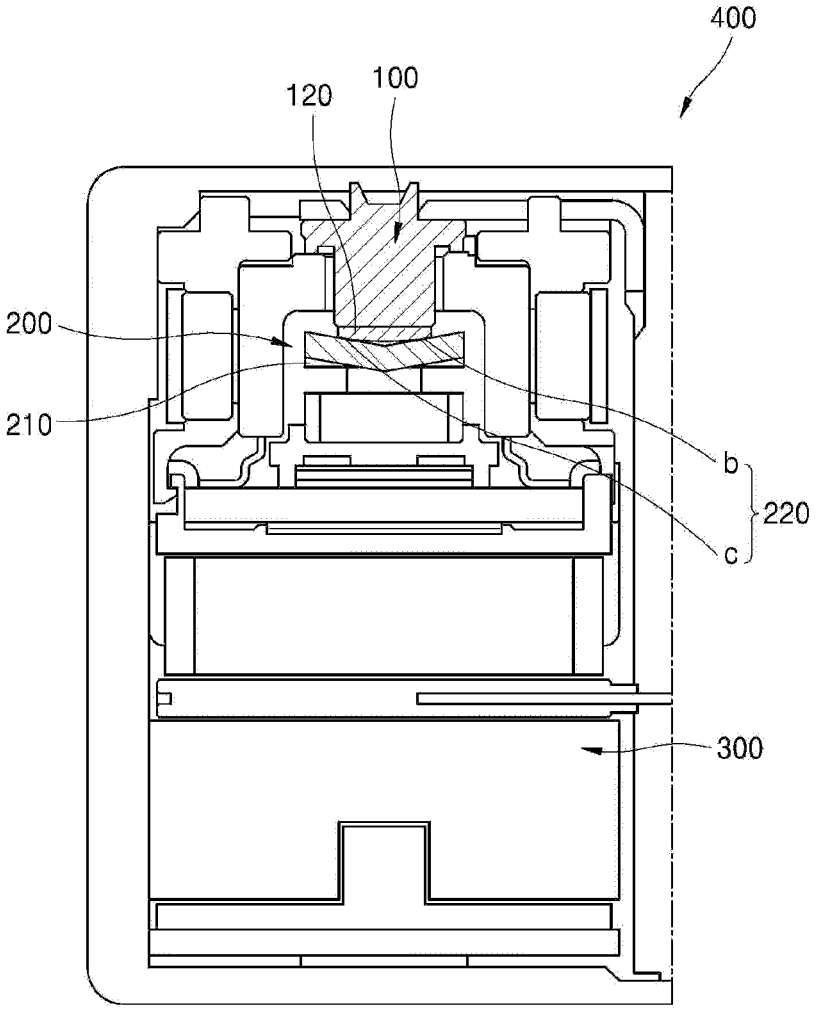
FIG. 4 is a cross-sectional view illustrating a state in which the mover shown in FIG. 2 is moved in a first direction.

FIG. 1 is a cross-sectional view illustrating an internal structure of a relay apparatus according to one embodiment of the present invention, and FIG. 2 is a cross-sectional view taken along line "II-II" of FIG. 1. Further, FIG. 3 is a perspective view illustrating a mover shown in FIG. 2, and FIG. 4 is a cross-sectional view illustrating a state in which the mover shown in FIG. 2 is moved in a first direction.

Referring to FIGS. 1 and 2, a relay apparatus 400 according to one embodiment of the present invention includes a stator 100, a mover 200, and an actuator 300.

The stator 100 is accommodated in a case 10 forming an exterior of the relay apparatus 400 according to the present embodiment and may be connected to a load such as a wiper motor or direction indicator of automobiles, to control the supply of power applied to the load.

A pair of stators 100 may be installed on an upper side of the case 10 to be separated from each other, and a first fixed contact point 110 and a second fixed contact point 120 are provided to be spaced apart from each other on the stators 100.

The first fixed contact point 110 and the second fixed contact point 120 may be electrically connected to each other by being brought into contact with the mover 200, which will be described later, and may be provided in the form of an electrode made of a molybdenum (Mo) metal material.

The mover 200 is provided inside the case 10 to be movable in a first direction which is a direction close to the stators 100, or in a second direction which is a direction far from the stators 100.

The mover 200 moves in the first direction and may be electrically connected to the stators 100 by being brought into contact with the first fixed contact point 110 and the second fixed contact point 120 provided in the stators 100. Also, the mover 200 moves in the second direction and moves away from the stators 100 to allow the electrical connection with the stators 100 to be broken.

The specific structure and operation of the mover 200 will be described later.

Like the mover 200, the actuator 300 is provided inside the case 10 to move the mover 200 in the first direction or the second direction.

According to the present embodiment, the actuator 300 includes a coil 310, a fixed core 320, and a movable core 330.

The coil 310 is installed inside the case 10 to generate a magnetic force, and the fixed core 320 is disposed inside the coil 310. Further, the movable core 330 is disposed so as to be close to and away from the fixed core 320.

Here, the coil 310 and the fixed core 320 are referred to as so-called electric armatures, and the movable core 330 is referred to as an armature.

The movable core 330 and the fixed core 320 are disposed to be spaced apart from each other along a moving direction of the mover 200, that is, an axial direction which is a concept including the first direction and the second direction to which the mover 200 moves. The movable core 330 may be provided so as to be linearly reciprocable with respect to the fixed core 320.

As another example, the actuator 300 may be configured so that the movable core 330 is rotatable with respect to the fixed core 320.

Hereinafter, an example of the actuator 300 in which the movable core 330 is configured to be linearly reciprocable with respect to the fixed core 320 will be described.

The above-described actuator 300 may further include a yoke 340 that forms a magnetic path together with the fixed core 320 and the movable core 330.

The yoke 340 may include a first yoke 341 having a plate form and a second yoke 343 having an approximate U-shaped cross section. The fixed core 320 may be coupled to a central portion of the first yoke 341.

The coil 310 is disposed inside the yoke 340 and typically wound around a circumference of a cylindrical bobbin 305. The coil 310 is connected to a coil terminal 20 for connection to a power source.

The coil 310 may be connected to a DC power source and configured as a DC relay, or connected to an AC power source and configured as an AC relay. An inside of the bobbin 305 may be formed to have an inner diameter to such an extent that allows the fixed core 320 to be embedded in and coupled to the inside.

Further, the actuator 300 may further include a working rod 350 configured to transmit a movement of the movable core 330 to the mover 200.

The working rod 350 may be formed in the form of a rod having a length extending in an axial direction. Also, one end portion of the working rod 350 is connected to a center portion of the mover 200 and the other end portion of the working rod 350 is connected to the movable core 330.

A rod hole (not numbered) is formed to pass through a center portion of the fixed core 320 and the working rod 350 may pass through a center of the fixed core 320 through the rod hole.

Such the working rod 350 is moved in the first direction or the second direction in conjunction with the movement of the movable core 330, and the mover 200 is moved in the first direction or the second direction by the movement of the working rod 350, and thus the stator 100 and the mover 200 may be connected or disconnected.

The operation of the actuator 300 having the above-described configuration may be performed as described below.

When power is supplied to the coil terminal 20 and the power is applied to the coil 310, a magnetic flux is generated, and the generated magnetic flux flows along a magnetic path formed by the yoke 340, the fixed core 320 and the movable core 330.

Accordingly, the movable core 330 moves instantaneously toward the fixed core 320, that is, toward a direction in which magnetic resistance decreases, and comes into contact with the fixed core 320, and the working rod 350 moves in the first direction in conjunction with the movement of the movable core 330.

The mover 200 is moved in the first direction by the movement of the working rod 350 so that the stator 100 and the mover 200 are brought into contact with each other and electrically connected to each other.

Meanwhile, when the power supplied to the actuator 300 is cut off and the supply of power to the coil 310 is stopped, the generation of the magnetic force is also stopped, and the movable core 330 returns to an initial position thereof by an elastic force of a return spring (not numbered).

Accordingly, the working rod 350 moves in the second direction to move the mover 200 in the second direction, and as a result, the mover 200 is separated from the stator 100 and the supply of the power to the load is stopped.

The mover 200 of the present embodiment, which is provided to perform the above-described actions, has a length extending along a separation direction of the stators 100 disposed to be spaced apart from each other along a width direction of the relay apparatus 400, and may be formed in a form of a metal plate through which a current can flow.

As shown in FIGS. 1 to 3, the mover 200 includes a first mover portion 210 and a second mover portion 220.

The first mover portion 210 corresponds to any one of two portions that are divided along the longitudinal direction of the mover 200.

In the present embodiment, a portion corresponding to a portion located on a side of the first fixed contact point 110 among the two divided portions of the mover 200 is exemplified as the first mover portion 210.

A first contact surface a which is provided to be in contact with the first fixed contact point 110 is formed on the first mover portion 210.

The first contact surface a is formed on a surface of the first mover portion 210 facing to the stator 100 to be a plane surface parallel to the first fixed contact point 110.

The first mover portion 210 is electrically connected to the stator 100 by being brought into contact with the first fixed contact point 110 through the first contact surface a formed as described above.

The second mover portion 220 corresponds to another portion except the portion corresponding to the first mover portion 210 among the two portions divided along the longitudinal direction of the mover 200.

In the present embodiment, a portion corresponding to a portion located on the side of the second fixed contact point 120 among the two divided portions of the mover 200 is exemplified as the second mover portion 220.

A second contact surface b and a third contact surface c which are provided to be in contact with the second fixed contact point 120 are formed on the second mover portion 220.

The second contact surface b and the third contact surface c are each formed on a surface of the second mover portion 220 facing the stator 100 to be an inclined oblique surface with respect to the second fixed contact point 120.

When the mover 200 moves in the first direction, each of the second contact surface b and the third contact surface c formed on the second mover portion 220 is brought into contact with the second fixed contact point 120, and may be brought into contact with the second fixed contact point 120 at different positions.

According to the present embodiment, the second contact surface b is formed on one portion of the second mover portion 220 when the second mover portion 220 is divided in half along a width direction of the mover 200, and the third contact surface c is formed on the remaining portion of the second mover portion 220.

Each of the second contact surface b and the third contact surface c, which is provided on the second mover portion 220 as described above, is linearly symmetrical about an imaginary line separating the second contact surface b and the third contact surface c, and may be formed to be inclined upwardly toward an end of the mover 200 in a width direction.

In the present embodiment, it is exemplified that the second contact surface b and the third contact surface c are formed to be inclined to form a V-shape.

The second mover portion 220 including the second contact surface b and the third contact surface c having such a shape may be formed by pressing a portion corresponding to the second mover portion 220 of the mover 200 provided in the form of a flat metal plate in a V-shape.

Accordingly, the mover 200 having the first mover portion 210 and the second mover portion 220 includes three contact surfaces composed of the first contact surface a, the second contact surface b, and the third contact surface c.

As shown in FIGS. 3 and 4, the stator 100 and the mover 200 are electrically connected to each other in the form of a three-point contact in which the first contact surface a is brought into contact with the first fixed contact point 110 and each of the second contact surface b and the third contact surface c is brought into contact with the second fixed contact point 120.

In the case of the conventional relay apparatus in which a mover is in the form of a plane surface, to generate an electrical connection between the stator and the mover, generally, the stator and the mover are brought into contact with each other in a two-point contact manner in which the stator is brought into contact with the mover at two points.

When the stator and the mover are brought into contact with each other, there may be a difference in a contact pressure acting on two contact points at which the stator and the mover are brought into contact with each other. The difference in the contact pressure may be caused by tolerances generated in the process of manufacturing or assembling components constituting the stator and the mover, or shape deformation of components constituting the stator and the mover while using the relay apparatus.

As described above, when the contact pressures acting on each of the two contact points at which the stator and the mover are brought into contact with each other are different, the contact stability between the stator and the mover is lowered due to an influence of the current oscillation while the current flows.

That is, according to the conventional relay apparatus, since the stator and the mover are brought into contact with each other in the form of the two-point contact, the contact stability between the stator and the mover is lowered due to the influence of the current oscillation, thereby increasing contact heat generated at the contact point between the stator and the mover.

Further, in order to reduce a level at which the contact stability between the stator and the mover lowers, a method of increasing sizes of the stator and the mover to increase the contact area between the stator and the mover may be used, but in this case, overall size of the apparatus may be larger than necessary.

In comparison with the conventional apparatus, the relay apparatus 400 of the present embodiment is provided in a form including the mover 200 having three contact surfaces composed of the first contact surface a, the second contact surface b, and the third contact surface c, that is, the three contact surfaces including one plane surface and two oblique surfaces.

As a result, the stator 100 and the mover 200 are electrically connected to each other in the form of the three-point contact in which the first contact surface a in the form of the plane surface is brought into contact with the first fixed contact point 110 and each of the second contact surface b and the third contact surface c in the form of the oblique surface is in contact with the second fixed contact point 120.

That is, the number of the contact points between the stator 100 and the mover 200 for electrical connection between the stator 100 and the mover 200 is increased to three points and thus the contact stability between the stator 100 and the mover 200 may be effectively improved.

According to the relay apparatus 400 including the above-described mover 200, the contact stability between the stator 100 and the mover 200 may be effectively improved to reduce contact heat generation and a shape of the mover 200 may be processed through a press process to easily manufacture the apparatus by increasing the number of the contact points between the stator 100 and the mover 200 by merely changing the shape of the mover 200 without changing a shape of the stator 100.

Further, the relay apparatus 400 of the present embodiment may effectively improve the contact stability between the stator 100 and the mover 200 by merely changing the shape of the mover 200 without increasing the sizes of the stator 100 and the mover 200, so that a relay apparatus with high contact stability may be provided while a size of the apparatus may be reduced.

Meanwhile, the above-described relay apparatus is merely one embodiment of the present invention, and there may be many other modified embodiments.

Figure 5:
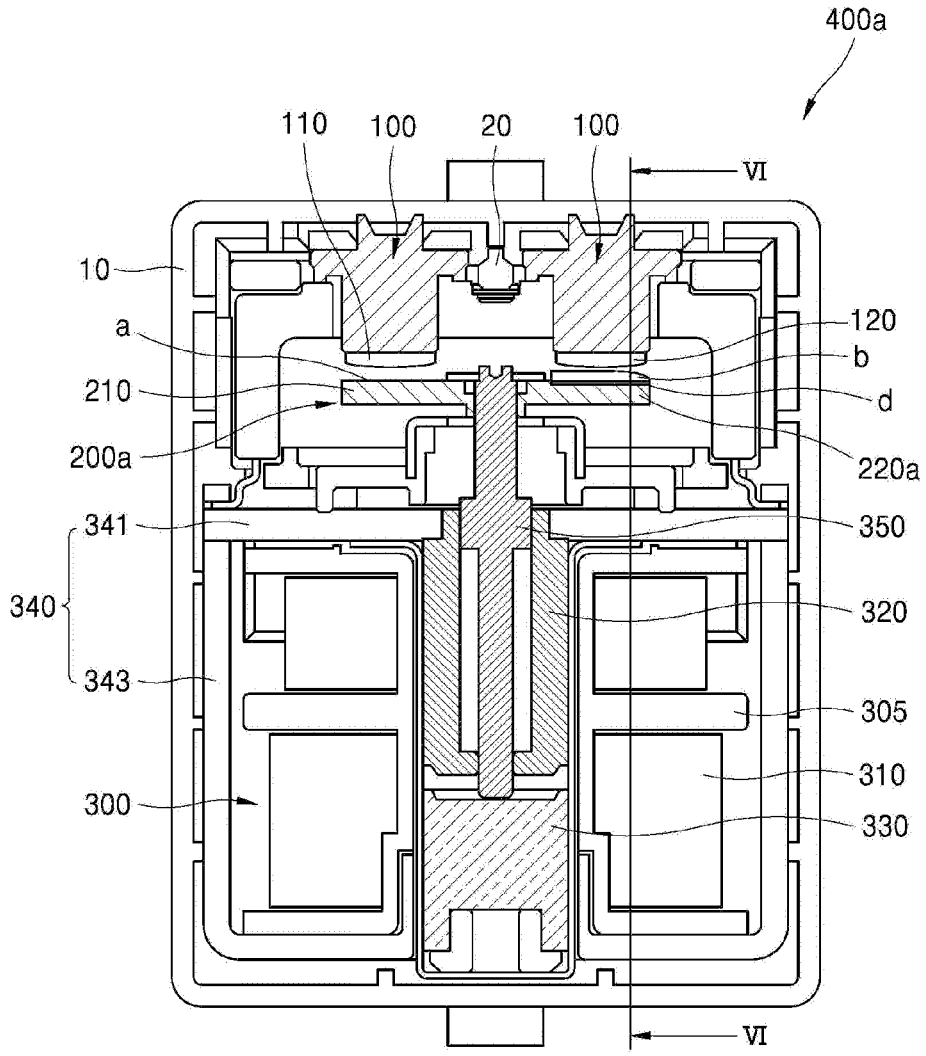
FIG. 5 is a cross-sectional view illustrating an internal structure of a relay apparatus according to another embodiment of the present invention.
Figure 6:
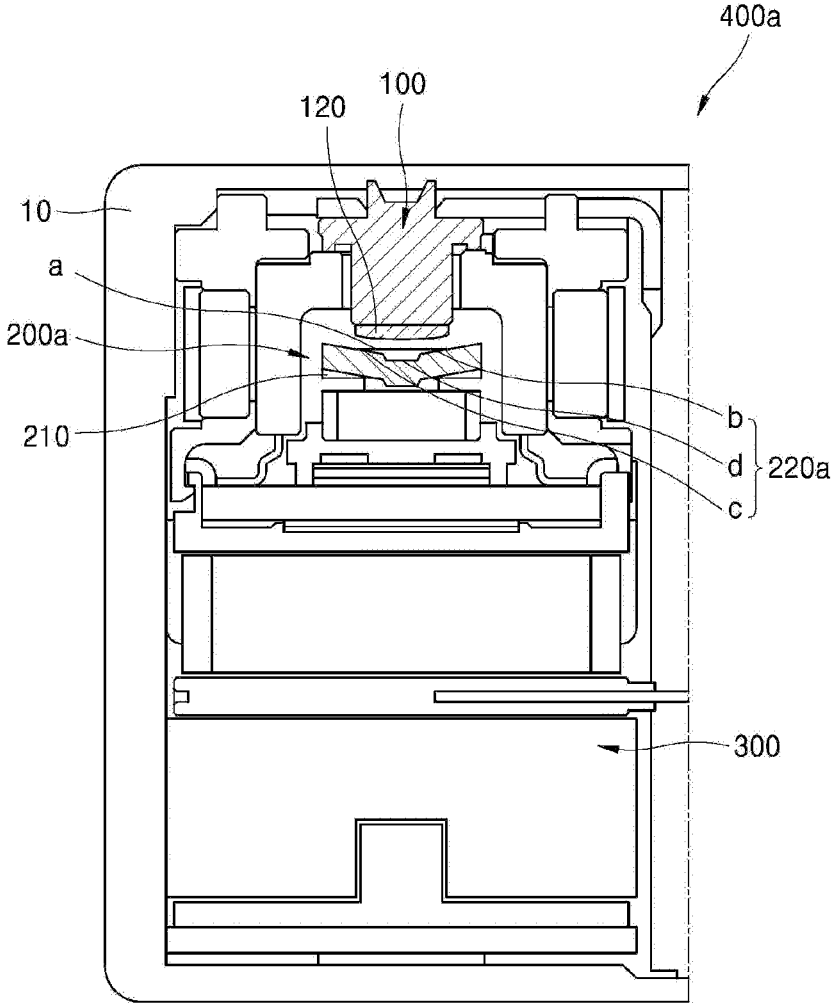
FIG. 6 is a cross-sectional view taken along line "VI-VI" of FIG. 5.
Figure 7:
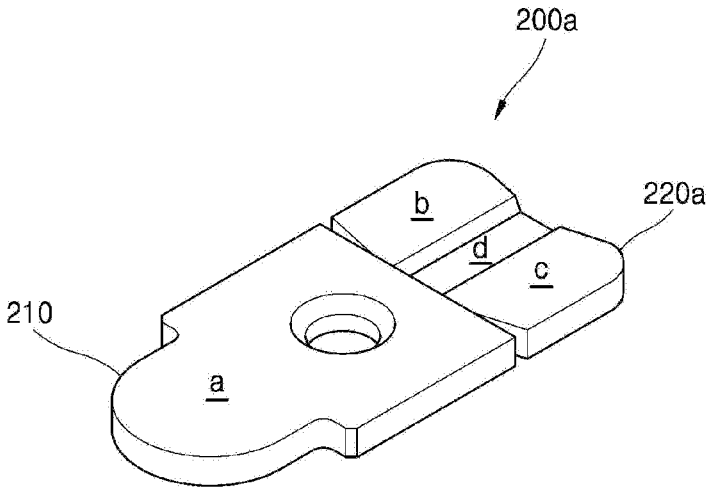
FIG. 7 is a perspective view illustrating a mover shown in FIG. 6.
Figure 8:
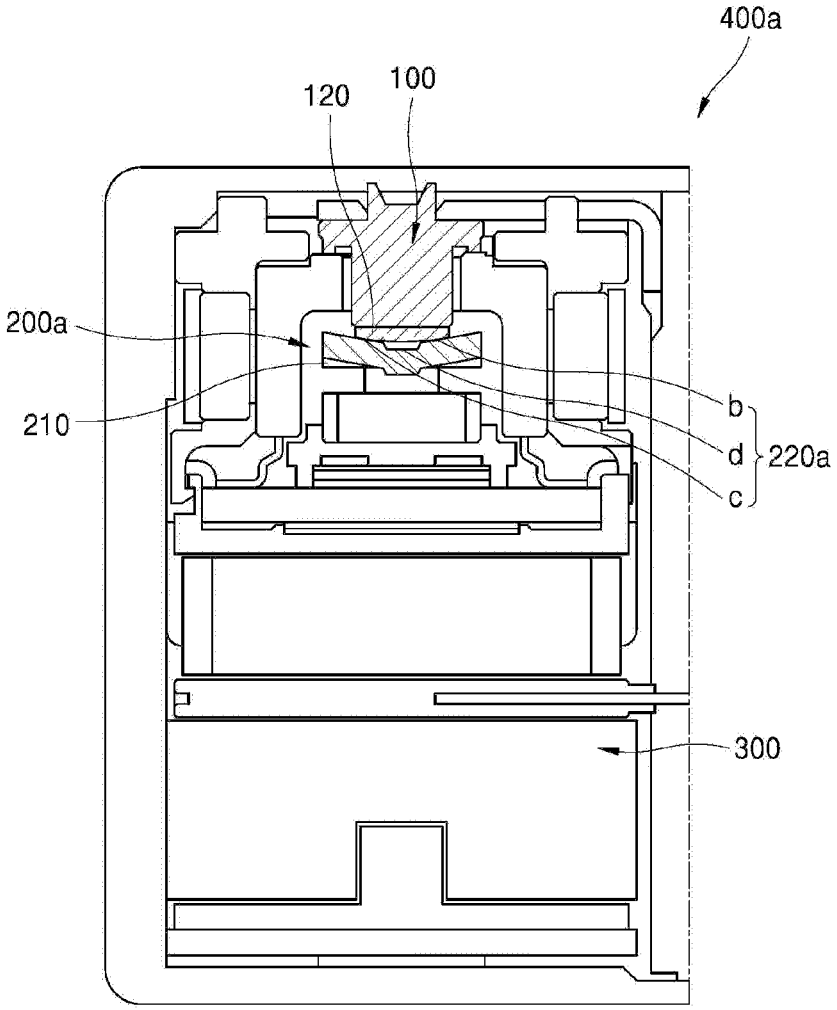
FIG. 8 is a cross-sectional view illustrating a state in which the mover shown in FIG. 6 is moved in a first direction.

FIG. 5 is a cross-sectional view illustrating an internal structure of a relay apparatus according to another embodiment of the present invention, and FIG. 6 is a cross-sectional view taken along line "VI-VI" of FIG. 5. Also, FIG. 7 is a perspective view illustrating a mover shown in FIG. 6, and FIG. 8 is a cross-sectional view illustrating a state in which the mover shown in FIG. 6 is moved in a first direction.

Hereinafter, modified embodiments of the relay apparatus according to the present invention will be described with reference to FIGS. 5 to 8.

For convenience of descriptions, the same or similar structures and functions as those of the above-described embodiment are referred to by the same reference numerals and a detailed description thereof will be omitted.

Referring to FIGS. 5 to 8, a relay apparatus 400*a* according to another embodiment of the present invention includes a stator 100, a mover 200*a*, and an actuator 300.

The configuration and operation of the stator 100 and the actuator 300 exemplified in the present embodiment are the same as those of the stator 100 and the actuator 300 exemplified in the above-described embodiment and thus a detailed description thereof will be omitted.

The mover 200*a* of the present embodiment includes a first mover portion 210 provided with a first contact surface a and a second mover portion 220*a* provided with a second contact surface b and a third contact surface c like the mover 200 (see FIG. 3) exemplified in the above-described embodiment.

Among the mover portions, the second mover portion 220*a* includes the second contact surface b and the third contact surface c which are linearly symmetrical about an imaginary line separating the second contact surface b and the third contact surface c and formed to be inclined upwardly toward ends of the mover 200*a* in a width direction. Here, a boundary portion d (hereinafter referred to as a "central boundary") between the second contact surface b and the third contact surface c is provided in a shape having a width greater than that of the corresponding portion of the mover 200 (see FIG. 3) exemplified in the above-described embodiment.

That is, in a press process, a plane surface connecting the second contact surface b and the third contact surface c is formed by the central boundary d by making a width of the central boundary d, which is a section in which a direction of the oblique surface is changed over, at the boundary portion between the second contact surface b and the third contact surface c wider.

A shape of the second mover portion 220*a* is determined such that the direction of the oblique surface at the boundary portion between the second contact surface b and the third contact surface c is not changed too rapidly by the central boundary d formed as described above.

As a result, a risk in which processing defects such as cracks are generated at the boundary portion between the second contact surface b and the third contact surface c in the press process for forming the oblique surface of the second mover portion 220*a* may be reduced.

Accordingly, the mover 200*a* of the present embodiment including the second mover portion 220*a* formed as described above may reduce a risk in which processing defects are generated in the processing process, thereby providing improved productivity.

In the relay apparatus 400*a* of the present embodiment including the above-described configuration, by merely changing the shape of the mover 200*a* without changing the shape of the stator 100, the contact stability between the stator 100 and the mover 200*a* may be effectively improved, the shape of the mover 200*a* may be easily manufactured by processing through the press process, and improved productivity may be provided due to less risk of processing defects in the press process.

Meanwhile, in the above-described embodiments, an example of the relay apparatus 400*a* in which the stator 100 and the mover 200*a* are contacted at three points by providing the first mover portion 210 on one side of the mover 200*a* and the second mover portion 220*a* on the other side of the mover 200*a* is described, but the present invention is not limited thereto.

According to the present invention, the relay apparatus may be provided in a four-contact configuration in which the stator and the mover are in contact at four points by providing the second mover portion 220 shown in FIG. 3 or the second mover portion 220*a* shown in FIG. 7 on both sides of the mover 200*a*. In addition, the relay apparatus of the present embodiment may be modified in various ways such as being provided in a form in which the stator and the mover are brought into contact with each other at a plurality of points that are more than five points.

While the above invention has been described with reference to the exemplary embodiments illustrated in the accompanying drawings, it should be understood that the invention is not limited to the disclosed embodiments, but is intended to cover various modifications and equivalent arrangements included within the sprit and scope of the appended claims. Accordingly, the scope of the present invention shall be determined only according to the attached claims.

DESCRIPTION OF REFERENCE NUMERALS

10: case
20: coil terminal
100: stator
110: first fixed contact point

120: second fixed contact point
200, 200*a*: mover
210: first mover portion
22-, 220*a*: second mover portion
300: actuator
305: bobbin
310: coil
320: fixed core
330: movable core
340: yoke
341: first yoke
343: second yoke
350: working rod
400, 400A: relay apparatus
a: first contact surface
b: second contact surface
c: third contact surface
d: central boundary

The invention claimed is:

1. A relay apparatus comprising:

a stator having a first fixed contact point and a second fixed contact point provided to be spaced apart from each other;

a mover movably provided in a first direction which is a direction close to the stator or in a second direction which is a direction far from the stator, and electrically connected to the stator by being brought into contact with the first fixed contact point and the second fixed contact point; and an actuator configured to move the mover in the first direction or the second direction, wherein the mover includes:

a first mover portion on which a first contact surface provided to be in contact with the first fixed contact point is formed; and a second mover portion on which a second contact surface and a third contact surface provided to be in contact with the second fixed contact point are formed, wherein the first contact surface is formed on the first mover portion to form a plane surface parallel to the first fixed contact point, and the second contact surface and the third contact surface are formed on the second mover portion to form an inclined oblique surface with respect to the second fixed contact point.

2. The relay apparatus of claim 1, wherein the second contact surface and the third contact surface are brought into contact with the second fixed contact point at different positions.

3. The relay apparatus of claim 1, wherein each of the second contact surface and the third contact surface is linearly symmetrical about an imaginary line separating the second contact surface and the third contact surface, and is formed to be inclined upwardly toward an end of the mover in a width direction.

4. The relay apparatus of claim 1, wherein the second contact surface and the third contact surface are formed to be inclined to form a V-shape.

5. The relay apparatus of claim 1, wherein a central boundary is formed at a boundary portion between the second contact surface and the third contact surface, and the central boundary forms a plane surface connecting the second contact surface and the third contact surface.

6. The relay apparatus of claim 1, wherein the stator and the mover are electrically connected to each other in a form of a three-point contact in which the first contact surface is brought into contact with the first fixed contact point and each of the second contact surface and the third contact surface is brought into contact with the second fixed contact point.

* * * * *